US006221180B1

(12) United States Patent
Tosaka et al.

(10) Patent No.: US 6,221,180 B1
(45) Date of Patent: Apr. 24, 2001

(54) STEEL SHEET FOR CAN AND MANUFACTURING METHOD THEREOF

(75) Inventors: Akio Tosaka, Chiba; Masatoshi Aratani, Handa; Osamu Furukimi, Chiba; Hideo Kuguminato, Chiba; Makoto Aratani, Chiba; Yuji Miki, Kurashiki, all of (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/445,404

(22) PCT Filed: Apr. 7, 1999

(86) PCT No.: PCT/JP99/01843

§ 371 Date: Dec. 7, 1999

§ 102(e) Date: Dec. 7, 1999

(87) PCT Pub. No.: WO99/53113

PCT Pub. Date: Dec. 10, 1999

(30) Foreign Application Priority Data

Apr. 8, 1998 (JP) ..... 10-096481
Oct. 8, 1998 (JP) ..... 10-286430

(51) Int. Cl.[7] ..... C21D 8/00; C22C 38/04
(52) U.S. Cl. ..... 148/320; 148/603; 148/651
(58) Field of Search ..... 148/320, 603, 148/651

(56) References Cited

U.S. PATENT DOCUMENTS 5,290,370 * 3/1994 Okada et al. ..... 148/603
5,582,658 * 12/1996 Masui et al. ..... 148/603
6,063,214 * 5/2000 Fujinaga et al. ..... 148/606

FOREIGN PATENT DOCUMENTS 1-116030 5/1989 (JP) .
6-41683 * 2/1994 (JP) .
6-220581 * 8/1994 (JP) .
8-176735 * 7/1996 (JP) .
8-325670 * 12/1996 (JP) .

OTHER PUBLICATIONS

"The Canmaker" vol. 9, Feb. 1996, pp. 32–37.

* cited by examiner

*Primary Examiner*—Deborah Yee
(74) *Attorney, Agent, or Firm*—Oliff & Berridge, PLC

(57) ABSTRACT

The invention provides a can steel sheet having satisfactory surface appearance and having workability, appearance property after working and high yield that can meet demands on complicated can forming, and a manufacturing process thereof. To be more specific, according to the invention, a slab having a composition containing, in weight %, C: more than 0.005% and equal to or less than 0.1%, Mn: 0.05–1.0% is subjected to hot-rolling at a finishing temperature of 800 to 1000° C., to coiling at 500 to 750° C., to cold-rolling, followed by continuous annealing at a recrystallization temperature or higher and 800° C. or lower, and then to box annealing at a temperature higher than 500° C. and equal to or lower than 600° C. for 1 hr or longer. The steel sheet has preferably a structure containing ferrite as a principle phase and having a mean grain diameter of 10 μm or less and further containing 0.1–1% by weight of pearlite grains each having a grain diameter of 0.5–3 μm. To obtain satisfactory surface appearance, it is preferable that the steel contains: Ti: 0.015–0.10%, Al: 0.001–0.01%, and a total of 0.0005–0.01% of one or two members of Ca, REM, and S−5×((32/40)Ca+(32/140)REM) of 0.0014% or less.

12 Claims, 4 Drawing Sheets

STEEL SHEET FOR CAN AND MANUFACTURING METHOD THEREOF

TECHNICAL FIELD

The present invention relates to a can steel sheet and a method for manufacturing the same. It relates to a can steel sheet advantageous for the application to three-piece cans, in particular, modified three-piece cans and method for manufacturing the same.

BACKGROUND ART

Can containers can be roughly classified according to their parts and configurations as either two-piece cans each composed of a main body and a top lid or three-piece cans each composed of a main body, top and bottom lids. In such a three-piece can, its main body is connected by a process such as soldering, resin bonding, welding or the like.

Recently, a demand has been increased for designed cans having more three-dimensional shapes than simply cylindrical cans, from the viewpoint of improving the design of cans. These circumstances are presented in, for example, a journal "*THE CANMAKER* February 1996, p32–37".

These designed cans are mainly manufactured as three-piece cans, formed into a cylindrical shape, connected and then formed into an objective shape such as a barrel shape by imparting strain in the circumferential direction to a cylindrical connected main body with the use of a delicate split tool, hydrostatic press or other technique.

The designed cans manufactured by such techniques are called as modified three-piece cans, and require being superior in the following properties to those of conventional three-piece cans.

(1) That no fracture occurs in a secondary forming (this term means a working for imparting design to the can after forming of a cylinder; hereinafter it will have the same meaning), (2) that no defective appearance occurs in the secondary forming, (3) that less decrease occurs in can height in the secondary forming, are required. Major fracture forms in the secondary forming include fractures in the vicinity of welded joint and fractures of main body unit, and major defective appearances in the secondary forming include rough surfaces and stretcher strain. When the can height decreases in the secondary forming, the can capacities of finished products or the yields of materials are hardly ensured. The higher a r-value is, the more the can height decreases.

In addition, in consideration of recent demands to reduce the thickness of materials for cost-reduction, (4) that a material strength (hardness) is high, (5) that the yield strength (YS) of a material is not excessively high, are also required. If the material strength (hardness) is low, the can body strength cannot be ensured, whereas if the yield strength (YS) of the material is excessively high, springback increases and weldability is deteriorated due to decreasing the roundness of the cylinder or variations in lap allowance.

Incidentally, manufacturing processes of can steel sheets have been roughly classified into;

(i) a manufacturing process of subjecting a low-C steel containing C:

about 0.01 to 0.10%, preferably 0.03% or more, to cold rolling and then to box annealing, (ii) a manufacturing process of subjecting a low-C steel to cold-rolling and then to continuous annealing.

(iii) a manufacturing process of subjecting a material steel (IF steel) to cold-rolling and then to continuous annealing, which material steel is obtained by adding a strong solute-C-stabilizing element such as Ti or Nb to an extra low-C steel containing C: less than 0.01%.

According to the process (i) of subjecting a low-C steel to box annealing, however, workability in secondary forming generally tends to be satisfactory, but the r-value can hardly be decreased, so that the decrease in can height cannot be avoided. According to this process, crystal grains are liable to become coarse and rough surfaces are somewhat liable to occur, inviting defective appearance. In addition, the steel become soft and the strength is hardly ensured, whereas if the steel is subjected to a generally-employed secondary rolling, it becomes hard, inviting an excessively high YS.

On the other hand, according to the process (ii) of subjecting a low-C steel to continuous annealing, the r-value can be decreased yet insufficiently as compared with the process of subjecting a low-C steel to box annealing, and the crystal grains become fine and hence the steel is facilitated to prevent rough surfaces and to ensure strength (hardness). However, the workability is insufficient, and fractures in particular in the vicinity of welded joint are liable to occur in the secondary forming. In addition, non-aging properties cannot be achieved and stretcher strain is liable to occur according to this process.

The process (iii) of subjecting an IF steel to continuous annealing generally provides excellent non-aging property, but allows the crystal grains to become coarse and hence are most disadvantageous for preventing rough surfaces and the highest in the r-value. These problems may provably be resolved by a process of conducting annealing in an imperfect manner, but sufficient workability for secondary forming can hardly be obtained.

As described above, according to the conventional processes, it is difficult to reduce the r-value less than 1.0 and to minimize the decrease in can height, and, in general, prevention of rough surfaces and ensuring of the secondary forming workability/non-aging property are hardly compatible.

Japanese Unexamined Patent Publication No. 1-116030 discloses a technique of subjecting a substantially low-C steel containing C: 0.10% or less to continuous annealing at a recrystallization temperature or higher and 800° C. or lower, and then to box annealing at a temperature ranging from 300° C. to 700° C. This technique provides a steel sheet for easy open can lid containing fine grains of grain size number #9 or more (corresponding to a mean grain diameter of 17.6 $\mu$m or less), being non-aging properties as is not aged by bake-coating of the lid, and being excellent in, for example, easy-open property. Even according to this technique, however, the r-value becomes 1.0 or more, and its secondary forming workability, hardness and rough-surface resistance do not meet the levels required in modified three-piece cans to which the present invention is directed.

It is an object of the present invention to provide a can steel sheet which can solve the problems of the conventional technologies and meets the workability, appearance property after working and high yield meeting even complicated requirements in can designs, and a method of manufacturing the same. It is another object of the present invention to provide a can steel sheet which effectively prevent the formation of surface defects due to alumina and other cluster inclusions, is satisfactory in surface appearance such as the aesthetics of appearance and defect-free property, and excellent in formability in welded joint, and a method of manufacturing the same.

DISCLOSURE OF INVENTION

The present inventors made intensive investigations to achieve the above objects. As a result, they newly found that reduction of the r-value, fining of crystal grains and hardening of resultant steels can concurrently be achieved through a combination of the addition of a proper amount of Mn and continuous annealing under proper conditions, and that improved secondary forming workability and non-aging property can be obtained by subjecting the steel further to a heat treatment of box annealing cycle.

In addition, the present inventors found that inhibition of deformation from focusing due to unevenness of thickness distribution is important to prevent main body cracking during secondary forming, and that it is effective to this end to control a crown in a product steel coil to 5 μm or less.

The present inventors further conceived that control of the composition of oxides and sulphides remained in the resultant steel is an important factor to improve the surface appearance of the steel and formability of welded joint. To be more specific, they found that by controlling the composition of these inclusions to a proper range and, more preferably, by optimizing the manufacturing processes of steels, can steel sheets can be obtained, which are resistant against rusting, are satisfactory in appearance property and excellent in formability of welded joint and suitable for three-piece cans as finished products.

The present invention has been accomplished on the basis of the above findings.

(1) A can steel sheet having a composition containing, in weight %, C: more than 0.005% and equal to or less than 0.1%. Mn: 0.05% to 1.0%, and a structure containing ferrite phase as a principle phase and having a mean grain diameter of 10 μm or less, and further having an r-value of 0.4 or more either in a rolling direction or in a direction perpendicular to the rolling direction and less than 1.0, and an Aging Index AI value of 30 MPa or less.

(2) The can steel sheet according to (1), wherein the steel sheet has a composition containing, in weight %, C: 0.03 to 0.1%, Mn: more than 0.5% and equal to or less than 1.0%.

(3) The can steel sheet according to either (1) or (2), wherein the structure includes ferrite phase as a principle phase, and 0.1 to 1% by volume of a pearlite phase having a grain diameter of 0.5 to 3 μm.

(4) The can steel sheet according to either (2) or (3), wherein the composition consists essentially of, in weight %, C: 0.03 to 0.1%, Mn: more than 0.5% and equal to or less than 1.0%, Al: 0.10% or less, and N: 0.0050% or less with the balance being Fe and incidental impurities.

(5) The can steel sheet according to (4), wherein the steel further includes, in addition to the above composition, at least one member selected from, in weight %, Ti: 0.20% or less, B: 0.01% or less, V: 0.1% or less and Nb: 0.1% or less.

(6) The can steel sheet according to (1), wherein the steel sheet further includes, in addition to the above composition, in weight %, Al: 0.001 to 0.01%, Ti: 0.015 to 0.10%, N: 0.02% or less, a total of 0.0005 to 0.01% of one or two members of Ca, REM, and the contents of S and one or two members of Ca, REM meet a relation represented by the following formula:

$$S-5\times((32/40)Ca+(32/140)REM)\leqq 0.0014$$

with the balance being Fe and incidental impurities, and wherein oxidic inclusions having grain diameter of 1 to 50 μm include Ti oxides and one or two members of CaO and REM oxides, and a recrystallization texture corresponds to an r-value of 1.0 or less either in a rolling direction or in a direction perpendicular to the rolling direction.

(7) The can steel sheet according to (6), wherein the oxidic inclusions having grain diameter of 1 to 50 μm include: Ti oxides: 20 wt % or more and 90 wt % or less, the total of one or two members of CaO and REM oxides: 10 wt % or more and 40 wt % or less, $Al_2O_3$: 40 wt % or less (the Ti oxides, one or two members of CaO and REM oxides and $Al_2O_3$ adding up to 100% or less).

(8) The can steel sheet according to any one of (1) through (7), wherein the total elongation EL (%) has the relation with respect to the thickness t (mm) of EL≧110t.

(9) The can steel sheet according to any one of (1) through (8), wherein a product steel coil has a crown of 5 μm or less.

(10) A method for manufacturing a can steel sheet, the method including the step of subjecting a steel slab containing, in weight %, C: 0.03 to 0.1%, Mn: more than 0.5% and equal to or less than 1.0% to hot-rolling which is completed at a finishing temperature of 800 to 1000° C., to coiling at a temperature of 500 to 750° C., to cold-rolling and then to continuous-annealing at a recrystallization temperature or higher and 800° C. or lower, and then subjecting the steel to box annealing at a temperature higher than 500+ C. and equal to or lower than 600° C. for 1 hr or longer.

(11) The method for manufacturing a can steel sheet according to (10), wherein the annealing temperature of the continuous annealing is controlled to 720° C. or higher.

(12) The method for manufacturing a can steel sheet according to either (10) or (11), wherein the crown of a hot-rolled steel sheet in the hot-rolling is controlled to 40 μm or less, and the crown of a cold-rolled steel sheet in the cold-rolling is controlled to 5 μm or less.

BEST MODE FOR CARRYING OUT THE INVENTION

Main bodies of three-piece cans are produced by a process of forming a material steel sheet to a cylindrical shape in such a manner that an L direction (rolling direction) of the steel sheet constitutes the circumferential direction of a resultant can (normal grain process), and by a process of forming a material steel sheet to a cylindrical shape in such a manner that a C direction (a direction perpendicular to the rolling direction) of the steel sheet constitutes the circumferential direction of a resultant can (reverse grain process).

Figure 4:
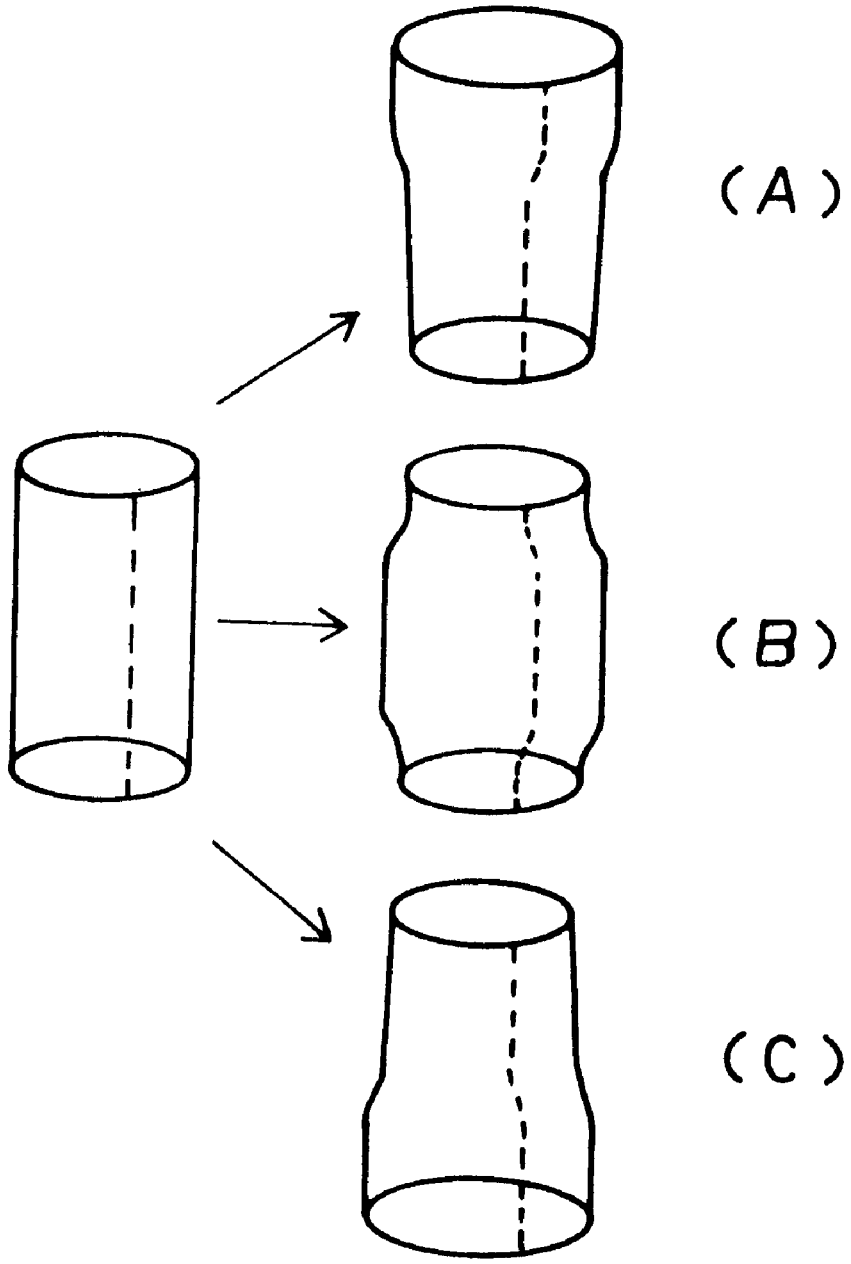
FIG. 4 is an explanatory diagram illustrating an illustrative modified three-piece can.

According to the normal grain process, the steel sheet is drawn in the L direction through secondary forming after the cylindrical forming (see FIG. 4). Accordingly, it has been found that a shrinkage in the can height direction has correlation with the shrinkage in the widthwise direction (a direction perpendicular to the stretching direction) upon application of tensile forming in the L direction of steel sheet, that is, an r-value in the L direction of steel sheet. On the contrary, according to the reverse grain process, a steel sheet is drawn in the C direction through secondary forming, and the shrinkage in the can height direction has, therefore, a correlation with an r-value in the C direction of steel sheet. Accordingly, the less is each r-value, the less is the shrinkage in the can axis direction after secondary forming. It has been also revealed that a high r-value facilitates the heterogeneity of can height in the circumferential direction. The can height after secondary forming is specified by canmakers. An excessively large shrinkage results in problems such that the contents cannot be ensured or that binding of a can lid, can bottom and a main body can not be ensured.

Initially, the present inventors made basic experiments, and the results will now be described in detail.

Figure 5:
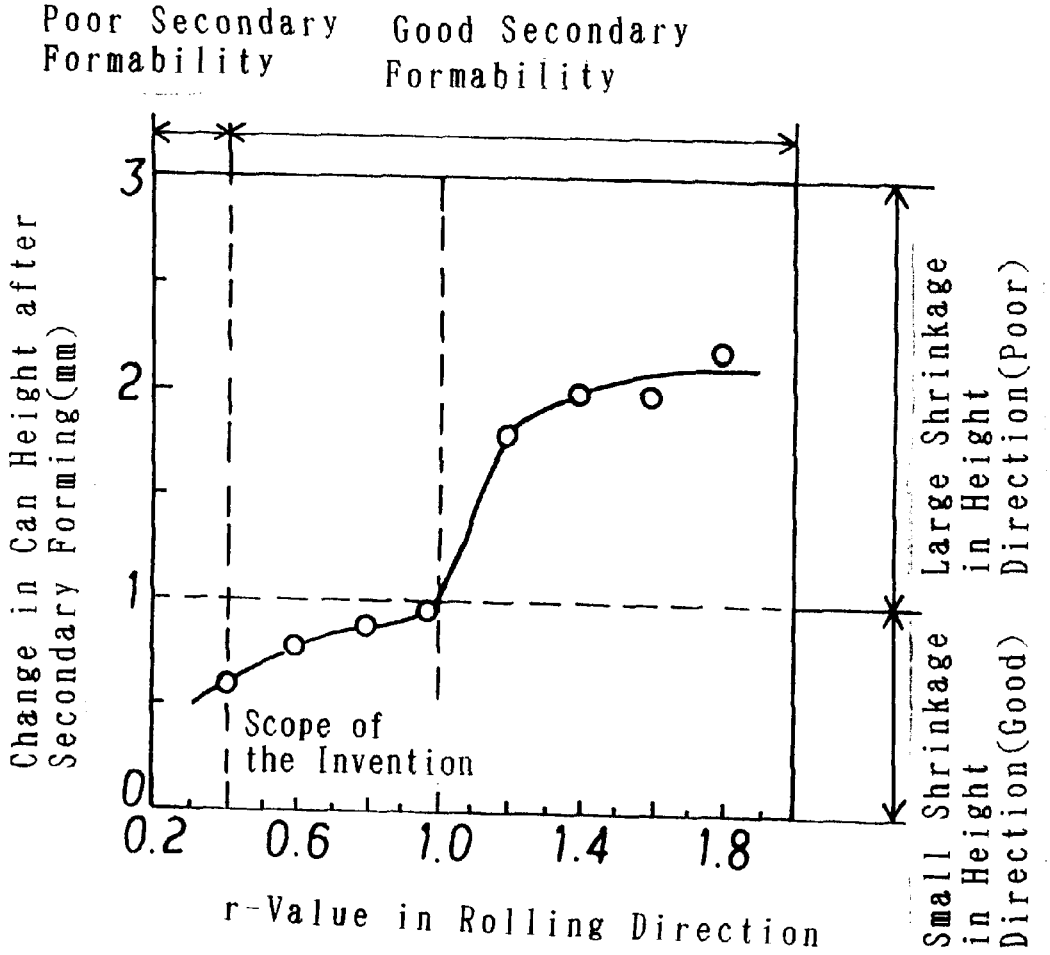
FIG. 5 is a graph illustrating the relation between changes of can height after secondary forming and an r-value in the rolling direction, affecting the secondary formability and shrinking liability in the can height direction.

A variety of product steel sheets were formed into a cylindrical shape by the normal grain process, and then subjected to secondary forming as illustrated in FIG. 4(B), and dimensional changes of the main bodies were investigated in detail. FIG. 5 illustrates the relation between an r-value in the rolling direction of steel sheet and changes in can height after secondary forming, demonstrating that r-values in the range from 0.4 to 1.0 are advantageous for reducing changes in can height direction and for ensuring sufficient workability.

This trend is also observed in the reverse grain process. Controlling the r-values of a steel sheet both in the L direction and C direction to the range from 0.4 to 1.0 is desirable, since changes of can heights can be minimized regardless of the direction of cylindrical forming.

In order to obtain such comparatively low r-values, the steel sheet should be annealed in a short time by a continuous annealing process. However, once the formation of a texture proceeds through recrystallization, the r-values will hardly change even after being subjected to a long-time annealing treatment such as box annealing.

Figure 2:
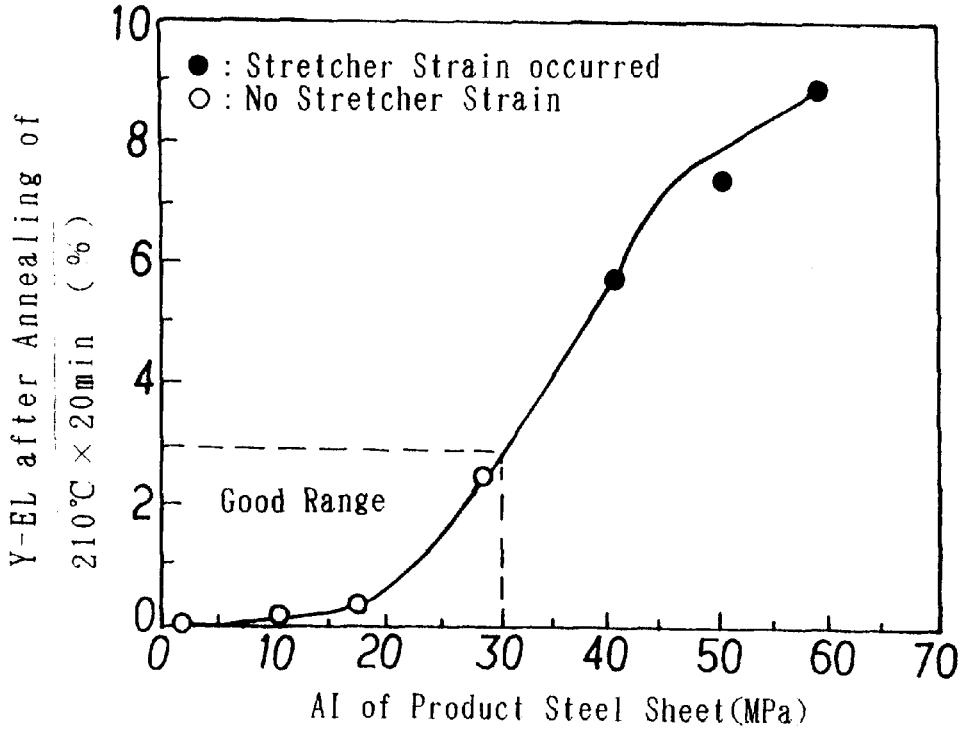
FIG. 2 is a graph illustrating the relation between the yield elongation in tension after an aging treatment and the Aging Index AI value.

Next, using a variety of product steel sheets, the relation between an elongation at yield point, Y-El, after aging treatment of 210° C.×20 min and an Aging Index AI value was studied. The results are shown in FIG. 2. The AI value is defined as the change of yield stress between before and after treatment when a product steel sheet is applied with a tensile prestrain of 7% and then subjected to an aging treatment of 100° C.×30 min. In addition, the same product steel sheet was formed to a barrel-shape can having a strain range corresponding to uniaxis of 0.05 to 0.15 which acts upon the steel sheet after secondary forming, and the presence or absence of the occurrence of stretcher strain in main body was investigated, and the results are also illustrated in FIG. 2. FIG. 2 demonstrates that prevention of the occurrence of stretcher strain requires the control of the elongation at yield point of the steel sheet to less than 3% and the Al value of steel sheet to 30 MPa or less both after an annealing treatment (210° C.×20 min) corresponding to painting and baking or film-laminate treatment. Further, the inventors found that controlling of C content to 0.03 to 0.1%, Mn content to more than 0.5%, Al content to 0.01 to 0.1% and N content to 0.0050% or less and application of box annealing cycle are effective to prevent the occurrence of stretcher strain. In addition, they found that it is essential for obtaining such a low-aging steel sheet to subject a material steel to continuous annealing for low r-values or the like and successively to an averaging treatment by box annealing and thereby to precipitate carbides and nitrides sufficiently and to reduce solute C and solute N as much as possible.

Figure 3:
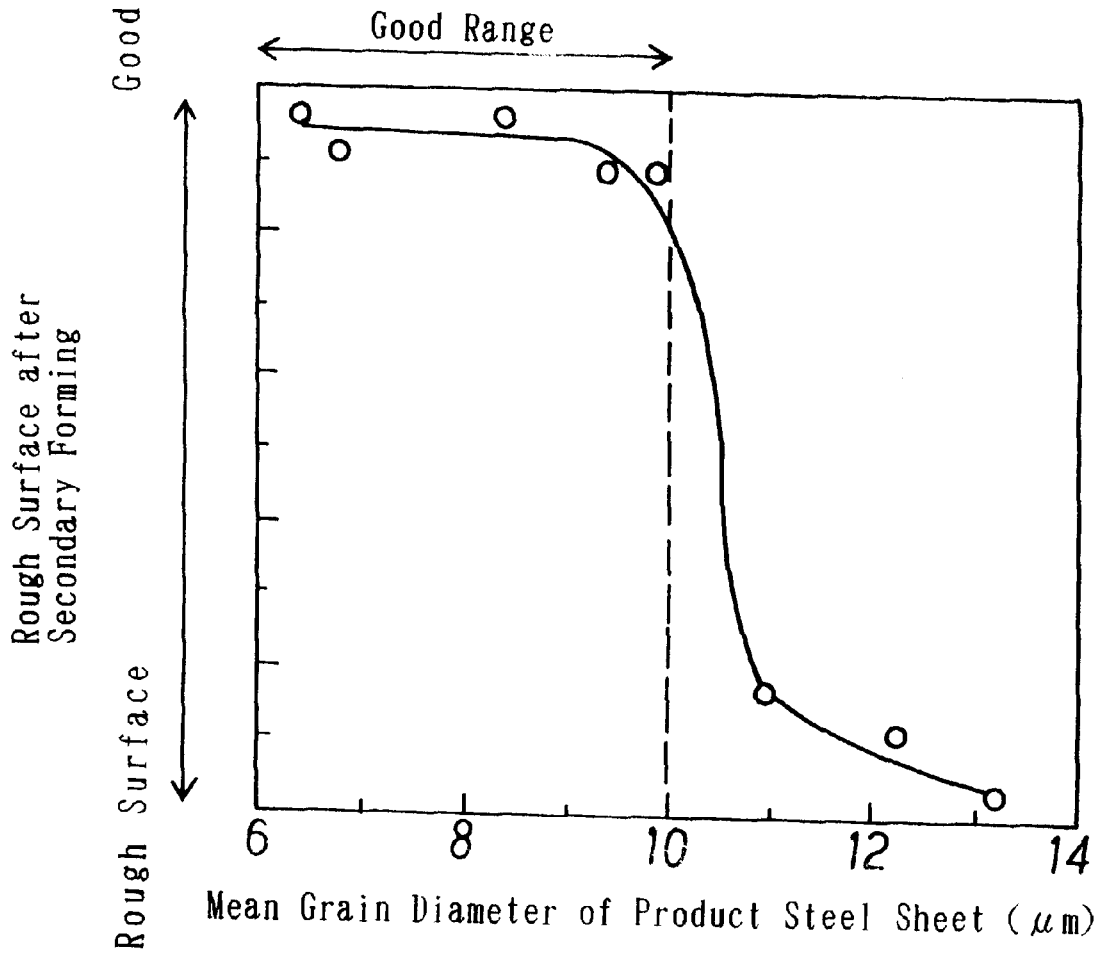
FIG. 3 is a graph illustrating the relation between rough surfaces after secondary forming and a mean grain diameter of a product steel sheet.

Next, the relation between rough surfaces and grain sizes after secondary forming was investigated, and the results are illustrated in FIG. 3.

FIG. 3 demonstrates that the grain diameter of a product steel sheet should be controlled to 10 $\mu$m or less to prevent the occurrence of rough surface after secondary forming. In order to control the grain diameter of a product steel sheet to 10 $\mu$m or less, it is preferable to adjust the C content to 0.03% or more and to conduct continuous annealing, a short-time annealing, as an annealing after cold-rolling, and to conduct successive box annealing as far as for crystal grains not becoming coarse and directing only to enhancing the precipitation of carbides and nitrides.

Figure 1:
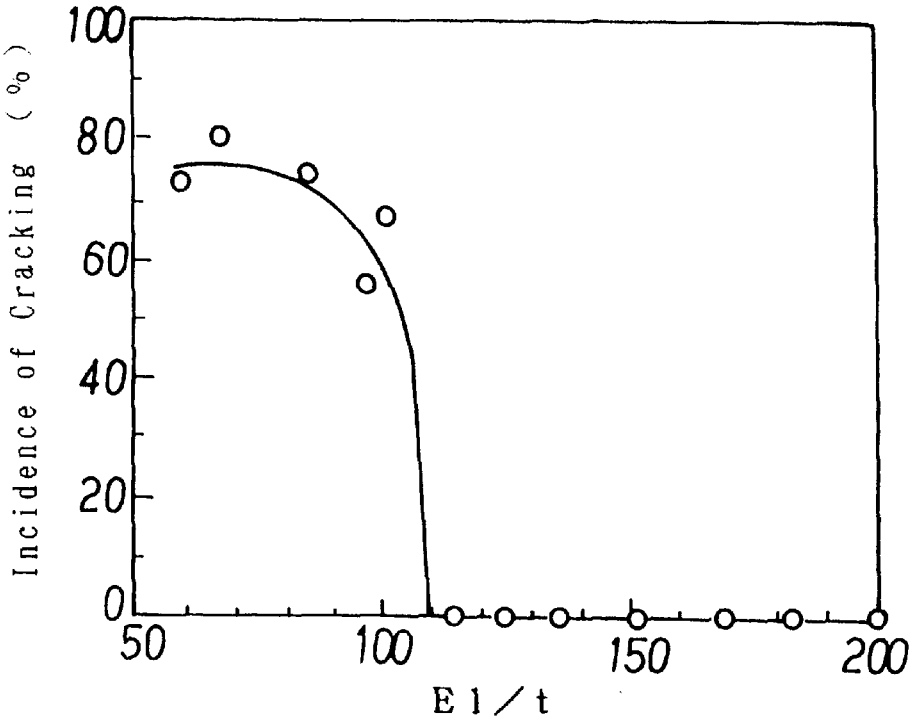
FIG. 1 is a graph illustrating the relation between cracking in secondary forming and El/t.

Subsequently, the relation between cracks and the ductility of a product steel sheet was examined, which cracks occurred in joint portion when a connected main body was subjected to secondary forming to a barrel-shape can (barrel shape can having a strain range corresponding to uniaxis of 0.05 to 0.15). The result as the relation between the ratio (EL/t) of total elongation of product steel sheet EL/thickness t and the incidence of crack is illustrated in FIG. 1. FIG. 1 demonstrates (EL/t) should be greater than 110 in order to prevent the formation of cracks after secondary forming.

It was found that controlling the C content to 0.1% or less, Mn content to 0.7% or less, Al content to 0.07% or less, and N content to 0.003% or less and conducting a short-time annealing by the continuous annealing process and a long-time annealing by the box annealing cycle in combination are effective to regulate (EL/t) to be greater than 110.

The content limits of the chemical composition of the steel according to the invention will now be described.

C: more than 0.005% and equal to or less than 0.1%

C is one of the important elements in the present invention, and the strength of a steel sheet as intact after annealing can be determined by increasing the C content. If the C content is 0.005% or less, crystal grains become excessively coarse, resulting in an increasing risk of rough surface when applied to cans. From the viewpoint of ensuring the stability of product mechanical properties, C content is controlled preferably to 0.010% or more.

On the contrary, if the C content exceeds 0.1%, the pearlite content in ferrite-pearlite structure increases to deteriorate both hot-rolling property and cold-rolling property, to harden the resultant product excessively, markedly deteriorating formability and corrosion resistance. Such resultant steel sheets are not preferable in the application of can steel sheets. In addition, the C content directly affects the increase of hardness of welded joint, and the hardness of welded joint increases with an increasing C content, resulting in deteriorated formability of welded joint.

The C content is preferably be controlled to the range from 0.03 to 0.1% from the viewpoint of strengthening steel sheets to obtain satisfactory strength of can bodies conforming to thinning and reducing aging property of the steel sheets. For reducing the aging property, it is required to precipitate cementite sufficiently and to decrease the solute amount in steels. When the C content is less than 0.03%, the strength of can bodies conforming to thinning cannot be obtained.

Mn: 0.05 to 1.0%

Mn is effective for deoxidation during steel making process and has an inhibitory effect on hot shortness of the steel.

For developing these advantageous benefits, Mn is preferably added in a content of 0.05% or more.

In addition, Mn is one of the essential elements for controlling the r-value of steel to a low r-value within the objective range. In modified three-piece cans, the r-values in L, C directions of product steel sheets require to be controlled to 0.4 or more and less than 1.0 in order to reduce the shrinkage in the can height direction after secondary forming. Although detailed mechanism is unknown, the effect of Mn on the reduction of r-values is provably because increase of solute Mn in steel effectively affects the reduction of r-values.

The addition of Mn presumably produces effects on the reduction of aging property of the steel sheet. Mn has an effect of retarding the moving rate of a cementite/ferrite boundary by condensing itself in the cementite. The cementite precipitated in a hot-rolled steel sheet partially forms solid-solution again during an annealing process, but the moving rate of the cementite/ferrite boundary becomes slow by condensing Mn in the cementite. This makes the resolution of cementite difficult. It is accordingly assumed that a steel sheet having low aging property can be obtained because Mn suppresses the increases of the solute of C in the annealing step.

In addition, Mn has an effect of solid-solution strengthening, and the addition of Mn is also effective for supporting the future thinning of product thickness. To develop these advantages, addition of Mn exceeding 0.5% is desired. On the other hand, when excessive amounts of Mn are added, the corrosion resistance is liable to deteriorate and the resultant steel sheet is hardened, so for canmaking workability including stretch flanging property is deteriorated. The upper limit of Mn content is therefore set at 1.0%, and preferably the Mn content is controlled to 0.7% or less.

The formation of cementite principally in pearlite provides extremely excellent non-aging property/ductility (EL). For forming such a pearlite, the contents are preferably controlled to: C: 0.03 to 0.1%, Mn: more than 0.5% and equal to or less than 1.0%.

N: 0.02% or less

N serves as a component for solid-solution strengthening and causes decreased ductility when resultant steel is applied to an extremely severe plastic working as in the present invention. The least N content is therefore desired. The N content is preferably limited to at most 0.02% in consideration of decrease amount of ductility with an increasing N content. In addition, N is an element enhancing aging property and increases the incidence of stretcher strain. From the viewpoint of aging property, the N content is more desirably controlled to 0.0050% or less, as the occurrence of problems in practical use can be prevented by controlling the N content to 0.0050% or less. The lower limit of the N content is not particularly restricted, and the limit of 0.0010% can be achieved commercially from the viewpoint of costs. The N content is preferably controlled to 0.0030% or less from the viewpoint of ductility, and more preferably controlled to 0.0020% or less from the viewpoint of ensuring stable mechanical properties.

Al: 0.10% or less

Al is an effective element for anti-ageing property by stabilizing solute N in the steel as AlN. Al is preferably added in a content of 0.010% or more for increasing the anti-aging property, and more preferably in a content of 0.05% or more in applications where more critical anti-aging property is required. Its upper limit is set at 0.10%, because the incidence of surface defects due to alumina cluster or the like increase suddenly with an increasing Al content. The desired upper limit of Al from the viewpoint of formability is 0.07%.

When the surface appearance of the product steel sheet is exactingly required, the Al content is preferably controlled to 0.01% or less. When the Al content exceeds 0.01%, the deoxidation is carried out through Al-deoxidation to form huge $Al_2O_3$ clusters in large quantity and thereby surface appearance is liable to deteriorate.

Separately, in the present invention, at least one member of Ti, B, V. Nb can be added instead of part of or the whole of Al for reducing solute N.

Ti: 0.20% or less

Ti is an element which reduces soluble N content by bonding with N as TiN, and an effective element for anti-aging property. To obtain this benefit, the amounts of Ti, B or the like are controlled according to the N content in the steel. When Ti is added singly, the desired Ti content is 0.01% or more, whereas a Ti content exceeding 0.20% results in increased costs, deteriorated ductility and increased surface defects. Accordingly, the Ti content is controlled to 0.20% or less and preferably 0.01% or more. When there are exacting requirements in surface appearance, the desired Ti content ranges from 0.015 to 0.10% for forming fine oxides and thereby for making crystal grains fine.

B: 0.01% or less

B is an element which reduces solute N content by bonding with N as BN, and is an effective element for anti-aging property. To obtain this benefit, the amounts of Ti, B or the like are controlled according to the N content in the steel. When B is added singly, the desired B content is 0.0003% or more, whereas a B content exceeding 0.01% causes increased costs and pronounced embrittlement of steel due to the formation of BN.

V: 0.1% or less

V is an element which reduces solute N content by bonding with N as VN, and is an effective element for anti-aging property. To obtain this benefit, the amounts of Ti, V or the like are controlled according to the N content in the steel. When V is added singly, the desired V content is 0.005% or more, and more preferably 0.01% or more, whereas a V content exceeding 0.1% invites increased costs and deteriorated ductility.

Nb: 0.1% or less

Nb is an element which reduces solute N content by bonding with N as NbN, and is an effective element for anti-aging property. To obtain this benefit, the amounts of Ti, Nb or the like are controlled according to the N content in the steel. When Nb is added singly, the desired Nb content is 0.002% or more, and more preferably 0.005% or more, whereas a Nb content exceeding 0.1% invites increased costs and deteriorated ductility.

If plural elements which reduce solute N content are added in combination for reducing the solute N content, their contents are preferably controlled to meet the following condition such that they are equivalent amounts or more of N, and preferably twice as much as N.

$$(14/27\cdot Al+14/48\cdot Ti+14/11\cdot B+14/51\cdot V+14/93\cdot Nb)\geqq N$$

wherein Al, Ti, B, V, Nb and N represent the contents (wt %) of individual elements.

When the present invention is applied to can steel sheets having stringent demands on surface appearance, it is preferred to control the sizes and compositions of inclusions in steels. To this end, it is preferable that the aforementioned Al content is further limited to a range from 0.001 to 0.01% and the aforementioned Ti content is further limited to a range from 0.015 to 0.10%, and the Ca and/or REM content is limited to a range from 0.0005 to 0.01%, and the contents of S and one or two members of Ca, REM meet a relation represented by the following formula:

$$S-5\times((32/40)Ca+(32/140)REM)\leqq 0.0014$$

Ti: 0.015 to 0.10%

In can steel sheets having stringent demands on surface appearance, Ti-deoxidation is conducted to form fine oxidic inclusions each having a size of 50 μm or less, and thereby grain growth in the cold-rolling-annealing step is controlled to make crystal grains fine and to improve the balance between strength and ductility. In addition, fine oxides of Ti can enhance the formability of welded joint by inhibiting the structure of welded joint (in particular heat-affected zone) from becoming coarse. If the Ti content is less than 0.015%, desired benefits cannot be obtained because of excessively small amount of the fine oxides, whereas if the Ti content exceeds 0.10%, the hot-rolling property, cold-rolling property and secondary cold-rolling property after annealing are noticeably decreased and the surface appearance of products is markedly deteriorated. The Ti content is, therefore, preferably controlled to a range from 0.015 to 0.10%, and more preferably to 0.05% or less for ensuring more excellent surface appearance.

Al: 0.001 to 0.01%

In product steel sheets having stringent demands on surface appearance, Al is preferably controlled to 0.01% or less. When the Al content exceeds 0.01%, the deoxidation is carried out through Al-deoxidation to form huge $Al_2O_3$ clusters in large quantity and thereby surface appearance is liable to deteriorate. In addition, Al content exceeding 0.01% results in decreased amount of fine oxides each having a size of 50 μm or less which can control grain growth in the cold-rolling-annealing step, causing increased risk of problems such as rough surfaces in canmaking. To be more important, when a large Al content renders the composition of inclusions to be $Al_2O_3$—CaO and/or $Al_2O_3$—REM oxides, and such inclusions constitute starting points of rusting and the corrosion resistance is liable to deteriorate. Thus, the Al content is preferably controlled to 0.01% or less when there are stringent demands on surface appearance. However, the Al content is advantageously controlled to 0.001% or more from the viewpoint stabilization of operation of degassing and continuous casting.

A total of one or two members of Ca. REM of 0.0005 to 0.01%

REM means and includes rare earth elements such as La and Ce. When satisfactory surface appearance is stringently demanded, addition of one or two members of Ca and REM in a content Of 0.0005% or more is desirable. After Ti-deoxidation, one or two members of Ca and REM are further added to 0.0005% or more so that oxides in molten steel are rendered to be low melting point oxidic inclusions having a composition of: Ti oxide: 20% or more and 90% or less, preferably 85% or less, CaO and/or REM oxide: 10% or more and 40% or less, $Al_2O_3$: 40% or less.

This procedure effectively inhibits Ti oxides including metallic Ti from adhering to a nozzle and hence prevents the nozzle from plugging during continuous casting. In addition, CaO and/or REM oxides can contribute to prevention of grain-growth after cold-rolling-annealing and inhibition of grains in welded joint (in particular welded heat-affected zone) from becoming coarse. For these reasons, the steel should comprise one or two members of Ca and REM in total of 0.0005% or more. On the contrary, total content of Ca, REM exceeding 0.01% increases risk of the occurrence of surface defects and invites pronounced decrease of corrosion resistance which is important for can steel sheets. The desired upper limit is therefore set at 0.01%.

Ca may be added for deoxidation, but its addition in an amount exceeding 0.01% deteriorates the workability.

$$S-5\times((32/40)Ca+(32/140)REM)\leqq 0.0014$$

As S is a harmful component to the workability of the steel, the least S content is desired. As excessive desulfurization, however, results in increasing costs, the preferred upper limit is 0.01% in consideration of costs required for desulfurization treatment and of improving effect of mechanical properties. The more preferred upper limit is 0.005% from a workability view. While S is possibly present as a variety of sulphides in the steel, if present as MnS-based inclusion, it elongates markedly in the rolling direction in hot-rolling step so as to promote cracking during canmaking process of final products. In this respect, the addition of Ca, REM improves the forming of sulphides and non-ductility and markedly improves the formability of worked zone including welded join. According to an investigation made by the present inventors, the addition of Ca, REM renders S to be harmless sulphides in an atomic ratio up to about five times as much as the elements, for some unknown reasons. Accordingly, when the amount of harmful S, that is, S−5×((32/40)Ca+(32/140) REM) is sufficiently small, no decrease of the workability due to sulphides occurs. The investigation made by the present inventors revealed that if the amount of harmful S represented by the above formula is 0.0014% or less, there is no problem.

O: 0.10% or less

O is a required component for the formation of fine oxides, but if added in a content exceeding 0.010%, coarse $Al_2O_3$ are formed in large quantity to decrease the ductility and deep drawability. The preferred upper limit is therefore 0.10%, and more preferably 0.007%. The still further preferable 0 content is 0.005% or less.

When satisfactory surface appearance is stringently demanded, it is preferable to control the Al content, Ti content and Ca and/or REM content to proper ranges, and in addition to control the content of S and one or two members of Ca, REM to optimized range for reducing harmful S, and to render oxidic inclusions each having grain diameter of 1 to 50 μm to contain Ti oxides and one or two members of CaO, REM oxides.

By allowing the inclusions as products of deoxidation to be Ti oxides and one or two members of CaO, REM oxides, to be more specific, Ti oxide-CaO and/or REM oxide-$Al_2O_3$-$SiO_2$ inclusions, a can steel sheet can be provided with less rusting and almost no deterioration of deformability due to inclusions and precipitation, and no defective surface due to cluster inclusions.

The reason for limiting the oxidic inclusion specified in the present invention to that having grain diameter of 1 to 50 μm is that inclusions within this range can be considered as inclusions produced by deoxidation. On the contrary, inclusions each having grain diameter exceeding 50 μm are generally composed of slag, mold powder and other adventitious inclusions. Some $Al_2O_3$ clusters are greater than the inclusions, but if only the inclusions having grain diameter of 50 μm or less have such oxide composition as to meet the above condition, such huge $Al_2O_3$ clusters can be considered to decrease sufficiently.

The more preferred composition of the oxidic inclusions having grain diameter of 1 to 50 μm is such that: Ti oxides: 20 wt % or more and 90 wt % or less, a total of one or two members of CaO, REM oxides: 10 wt % or more and 40 wt % or less, $Al_2O_3$: 40 wt % or less (where the total of Ti oxides, one or two members of CaO, REM oxides, and $Al_2O_3$ is 100% or less).

When the Ti oxide content in the inclusion is less than 20 wt %, not a Ti-deoxidation steel but an Al-deoxidation steel is formed and nozzle plugging occurs due to increased $Al_2O_3$ concentration. As rusting property increases with an increasing concentration of CaO and REM oxides, the Ti oxides concentration is preferably controlled to 20 wt % or more. On the other hand, if the Ti oxides concentration exceeds 90 wt %, the proportion of CaO, REM oxides decreases, causing nozzle plugging. Therefore, the Ti oxides concentration is preferably controlled to 90 wt % or less and more preferably, 30 wt % or more and 80 wt % or less.

If a total of one or two members of CaO, REM oxides in the above inclusion is less than 10 wt %, the inclusions fail to provide the inclusions to have low melting point and thus invite nozzle plugging. On the contrary, if it exceeds 40 wt %, the inclusionse absorb S thereafter and becomes water-soluble, constituting origin of rusting to deteriorate corrosion resistance. The more preferred range is from 20 to 40 wt %.

When the $Al_2O_3$ content in the inclusions exceeds 40 wt %, the inclusions become having a high-melting point composition, inviting nozzle plugging, and, in addition, the shape of the inclusion becomes cluster-form to increase defects due to non-metallic inclusions in product steel sheets. Incidentally, if the steel contains almost no Al, the $Al_2O_3$ concentration in the inclusion becomes almost negligible.

Other oxides than those mentioned above may be mixed to the oxidic inclusion. While the amounts of the other oxides than those mentioned above are not particularly limited, it is preferable that $SiO_2$ content is controlled to 30 wt % or less and MnO content is controlled to 15 wt % or less. This is because the resultant steel is no more a titanium killed steel sheet when these concentrations respectively exceed the above ranges. In addition, according to this composition, no nozzle plugging occurs and rusting problem is dissolved even without the addition of Ca. In consideration of the tendency of oxide formation, it is preferable to control the Si, Mn concentrations in a molten steel to such that Mn/Ti>100, Si/Ti>50, but this invites the hardening of steel and deteriorated surface appearance.

It is preferable that the oxidic inclusions having grain diameter of 1 to 50 $\mu$m occupies 80 wt % or more of total inclusion. This is because if the oxidic inclusions occupy less than 80 wt %, inclusions cannot be controlled sufficiently, and thereby causing defective surface of the steel coil or nozzle plugging.

Additionally, Si, P, S should preferably be reduced as much as possible.

Si: 0.10% or less

If Si is contained in large quantity, deterioration of surface treating property, deterioration of corrosion resistance and other problems will occur, and therefore the upper limit of Si content is set at 0.10%. In particular, 0.02% or less of Si is more advantageous when excellent corrosion resistance is required.

P: 0.04% or less

The upper limit of P content is set at 0.04%, since P contained in large quantity serves to harden the resultant steel, deteriorate its workability and deteriorate the corrosion resistance. The P content must be controlled to 0.01% or less when these properties are particularly valued.

S: 0.01% or less

S is present as inclusions and is an element serving to decrease the ductility of the steel sheet and to deteriorate the corrosion resistance. Its desired upper limit is therefore 0.01%. The S content should preferably be controlled to 0.005% or less particularly in the applications where satisfactory workability is required.

The balance is Fe and incidental impurities. As the incidental impurities, there may be mentioned, for example, Cu, Cr, Ni, Sn, Mo, Zn, Pb as contaminated elements from materials or scraps. When each of Cu, Cr, Ni is controlled to 0.2% or less, and each of Sn, Mo, Zn, Pb and other elements is controlled to 0.1% or less, their effects on properties in use as cans can be neglected.

In addition to the above composition, the steel should preferably have the following structure upon the completion of continuous annealing.

The can steel sheet of the present invention preferably has a structure containing ferrite phase as principle phase and pearlite phase in a volume ratio of 0.1 to 1%, which pearlite phase have a mean grain diameter of 10 $\mu$m or less, preferably the grain diameter of 0.5 to 3 $\mu$m. Incidentally, pearlite phase having grain diameter out of the above range is allowed to be contained 1% by volume or less.

By rendering the steel to have the above composition and structure, excellent properties of AI value $\leqq$20 MPa and EL/t$\geqq$120 can be obtained. This is probably because solute C is stabilized in cementite in the pearlite. The ferrite phase as the principle phase has only to be contained in a volume ratio of 95% or more.

Mean grain diameter: 10 $\mu$m or less

According to the present invention, the mean grain diameter of the product steel sheet is controlled to 10 $\mu$m or less for the purpose of preventing the occurrence of rough surface during secondary forming. It is preferably controlled to 5 $\mu$m or more from the viewpoint of ensuring the ductility. The term "mean grain diameter" used in the present invention means the mean grain diameter determined in a cross-section in the thickness direction (a cross section in the rolling direction) using a machining process in compliance with the requirements of Japanese Industrial Standards (JIS) G0552 (however, both end surfaces 5 $\mu$m each are excluded from the mean).

r-Value: 0.4 or more and less than 1.0 in a rolling direction or in a direction perpendicular to the rolling direction Controlling of the r-value in the rolling direction or in a direction perpendicular to the rolling direction to 0.4 or more and less than 1.0 can minimize the shrinkage in the longitudinal direction of the cylinder in secondary forming of the cylindrical main body, and can improve the yield of the steel. Although a deformed zone becomes thinner, the strength is increased by work-hardening, thus no problem occurs in can body properties and it is preferable from the viewpoint of the weight reduction of can body. The r-value has only to meet the above condition in a direction agreeing the stretch direction in secondary forming of canmaking, that is, either in the rolling direction or in a direction perpendicular to the rolling direction, and both r-values in the both directions should more preferably meet the condition.

Aging index Al value: 30 MPa or less

An AI value of the product steel sheet exceeding 30 MPa invites the formation of stretcher strain in secondary forming to cause defective appearance, the AI value must be controlled to 30 MPa or less, and preferably to 20 MPa or less.

Ratio of total elongation EL/thickness t (EL/t): 110 or more

To prevent the occurrence of cracks during secondary forming, the ductility in the deforming direction should be increased. It is therefore preferable that the ratio of total elongation in individual directions EL/thickness t (EL/t) is controlled to 110 or more, and more preferably to 140 or more.

Surface hardness: HR30T 50 to 57

When the hardness of the steel sheet in HR30T (Rockwell hardness) is less than 50, sufficient strength of can body cannot be obtained, thereby inviting problems such that the can is liable to be deformed by external force and that flanges formed top and bottom of the can are deformed by force acted from the can height direction in seaming of a lid onto the main body to inhibit backling of the lid. On the other hand, if it exceeds 57, flange-forming is deteriorated and cracks are liable to form. In addition, when it exceeds 57, temper-rolling exceeding 5% is required even according to the method of the present invention, increasing the springback in forming of the cylinder and thereby inviting the occurrence of poor weld. Thus the hardness preferably ranges from 50 to 57 in HR30T.

Next, limits of manufacturing conditions will be described.

Steel materials (slabs) each having the above composition are hot-rolled to give hot-rolled steel sheets, or these hot-rolled steel sheets are further cold-rolled to give cold-rolled steel sheets.

The limits of manufacturing conditions will now be described below.

Slab reheating temperature: 1000 to 1300° C.

A slab heating temperature to heat the slab prior to hot-rolling less than 1000° C. hardly ensures high finishing delivery temperature of the hot-rolling process, whereas reheating temperature exceeding 1300° C. significantly deteriorates the surface appearance of the steel sheet. Thus, the slab reheating temperature preferably ranges from 1000 to 1300° C. The slab can be reheated after cooling to room temperature, or reheated by inserting to a heating furnace without cooling. Separately, roughing rolling can be carried out prior to finishing rolling, or the finishing rolling can be carried out using a thin slab without roughing rolling.

Finishing rolling temperature: 800 to 1000° C.

If the finishing rolling temperature is lower than 800° C., the crystal grains of the finished product steel sheet hardly become fine, and the aesthetics of appearance after canmaking becomes void. However, a finishing rolling at a temperature exceeding 1000° C. is not preferable because of markedly increasing loss of scale. Thus, the finishing rolling temperature is specified to 800 to 1000° C. In this connection, the finishing rolling temperature is defined as a temperature determined at the rolling mill outlet side according to a conventional method.

In the hot-rolling, it is preferable to conduct a rolling process to make a crown of the resultant hot-rolled steel sheet 40 μm or less, for the purpose of finishing the crown of the cold-rolled steel sheet 5 μm or less without laboring. As the rolling for making the crown of the hot-rolled steel sheet 40 μm or less, roll-cross-type rolling is preferably carried out, and in particular, upon finishing rolling, rolling with pair cross rolls at three stands or more is desirably carried out.

The term "crown (sheet crown)" is defined as the absolute value (the mean value of measured values obtained by measuring both edges of widthwise direction) of [thickness in the center of widthwise direction—thickness at the edge of widthwise direction (30 mm from the extreme edge)].

Coiling temperature: 500 to 750° C.

A coiling temperature less than 500° C. deteriorates the shape of the steel sheet and uniformity in the mechanical properties in the widthwise direction of the steel sheet. The coiling temperature is preferably controlled to 600° C. or higher to stabilize solute N as AlN or the like and to reduce aging property. When the stabilization of solute N is mainly carried out by Ti alone, the coiling temperature can be as low as 500° C. On the other hand, if the coiling temperature exceeds 700° C., cementite aggregates and becomes coarse to increase the r-value after cold-rolling and annealing higher than the objective range, and decreasing the uniformity of the structure of hot-rolled mother steel sheet and increasing the thickness of scale remarkably to deteriorate descaling property.

It is preferred to remove scales formed on the surface of the hot-rolled steel sheet by, for example, pickling prior to cold-rolling. Pickling conditions are not particularly limited, and conventional pickling with hydrochloric acid or sulfuric acid is advantageous.

The pickled hot-rolled steel sheet is then subjected to cold-rolling. The condition of cold-rolling is not particularly specified, and a cold-rolling of 80% or more is advantageous in the manufacturing of an ultrathin steel sheet for hot-rolling and pickling costs. In the cold-rolling, the crown of the cold-rolled steel sheet is controlled to 5 μm or less.

If the crown exceeds 5 μm, fractures in the main body unit may occur during secondary forming of a steel sheet taken out from the vicinity of the edge in the widthwise direction. To achieve a crown of 5 μm or less, rolling of roll shift type or roll-cross-type (or both) is preferred, and rolling of both the roll shift type and roll-cross-type at least one stand or more is particularly preferred.

Annealing: by continuous annealing process at a recrystallization completing temperature or higher and 800° C. or lower According to the present invention, the steel sheet is required to be annealed at a recrystallization completing temperature or higher and to become a recrystallization structure, as there are demands for high secondary formability after cylindrical forming. Although a partial recrystallization structure is possibly employed in a special application, the stability of mechanical properties cannot be ensured. On the other hand, annealing at a high temperature exceeding 800° C. results in decreased strength at elevated temperature and increased risk of a defect called as heat buckle due to thin thickness of the steel sheet. In addition, if the steel sheet is annealed at a high temperature exceeding 800° C., the r-value of the steel sheet exceeds 1.0 with decreased can height after secondary forming. The crystal grains become coarse and there is a risk that rough surface occurs after secondary forming. The annealing should therefore be conducted by continues annealing process at a recrystallization completing temperature or higher and 800° C. or lower. In this connection, it was revealed that the non-aging property and ductility after box annealing are enhanced by rendering the structure after continuous annealing to be composed of ferrite phase as a principle phase, which ferrite phase contains a pearlite phase having a grain diameter of 0.5 to 3 μm in a volume ratio of 0.1 to 1%. To obtain such a structure, the annealing temperature is preferably controlled to 720° C. or higher.

Box annealing: holding for 1 to 10 hr at a temperature exceeding 500° C. and equal to or lower than 600° C.

According to the present invention, a heat cycle of box annealing type (this heat cycle is referred to as "box annealing" in the present invention) is carried out subsequent to the continuous annealing. The box annealing is a heat treatment as long-time soaking and slow cooling for the purpose of enhancing the precipitation of cementite and AlN, and preferably conducted by holding at a temperature exceeding 500° C. and equal to or lower than 600° C. for 1 to 10 hr. A heat treatment temperature equal to or lower than 500° C. fails to precipitate cementite, AlN or the like sufficiently, and decreases the ductility of the resultant steel sheet. On the other hand, when the heat treatment temperature exceeds 600° C., cementite becomes excessively coarse and recrystallization grains become coarse. Thus, the r-value becomes as great as 1.0 or more, inviting rough surface in secondary forming. The treatment temperature of box annealing is therefore controlled to exceeding 500° C. and equal to or lower than 600° C. A holdig time of the box annealing less than 1 hr fails to provide the above benefits, whereas a holding time exceeding 10 hr deteriorates the productivity, and hence the holding time preferably ranges from 1 to 10 hr. By precipitating cementite and AlN sufficiently, the anti-aging property and ductility are enhanced to prevent the occurrence of stretcher strain during secondary forming or cracking during secondary forming.

Secondary rolling reduction after annealing: 0.5 to 5%

Secondary cold-rolling is effected after the annealing according to necessity. The reduction of the secondary cold-rolling preferably ranges from 0.5 to 5% in order to ensure the can body strength, to ensure uniform mechanical properties of the annealed steel sheet and to reduce aging property by inducing mobile dislocation. If the reduction is less than 0.5%, desired benefits cannot be observed, whereas if it exceeds 5%, problems occurs such that the springback in cylindrical forming increases, the ductility is deteriorated or flange cracks occur due to anisotropy of the ductility.

Thickness of the product: 0.25 mm or less

Thinning of materials is pursued from the viewpoint of reducing canmaking costs, and the present invention is directed to meeting the demands of canmakers. Accordingly, the thickness is preferably controlled to 0.25 mm or less. The steel sheet (method) according to the present invention exhibits, at $t \leqq 0.25$ mm, particularly excellent secondary forming property as compared to those of conventional equivalents.

EXAMPLES

Example 1

A series of steels having chemical compositions shown in Table 1 were prepared by steel making in a converter and subjected to continuous casting to give slabs. These slabs were subjected to hot-rolling, cold-rolling, continuous annealing, and secondary cold-rolling under conditions shown in Table 2 to give cold-rolled steel sheets of 0.22 mm in finishing delivery thickness. Subsequently, the steels were subjected to continuous tin plating corresponding to #25 in a tin electroplating line of halogen type to give tinplates.

Test pieces were sampled from the rolling direction (L direction) and the cross direction (C direction) of thus obtained tin-plated steel sheets, and subjected to tests of total elongation EL, surface hardness HR30T, r-value, AI value and elongation at yield point (Y-EL) after an aging treatment corresponding to baking (210° C.×20 min), and the ratio of total elongation EL/t. In these tests, tensile test pieces of JIS No. 5 were used.

These steel sheets were cylindrically formed into cylinders of 250 g can size, and then subjected to a secondary forming using a press jig composed of a special split mold structure. The directions of tensile strain in the secondary forming were L direction (the normal grain process) and C direction (the reverse grain process), and the strain was controlled to average 7%. After canmaking, the presence or absence of cracking and the presence or absence of rough surface and stretcher strain were surveyed. In addition, changes in height in a can axis direction before and after the secondary forming were determined. Table 3 demonstrates these results. In this connection, the mean grain diameters of ferrite phase were determined on C cross sectional structures of the product steel sheets in compliance with the requirements of JIS G0552. The pearlite volume fraction was determined by scanning type electron microscope (SEM) observation on C cross sectional structures of the product steel sheets. When the surface roughness $Ra \geqq 1.0\ \mu m$, it was assessed as the occurrence of rough surface. When a stretcher strain was clearly observed visually, it was assessed as the occurrence of the stretcher strain.

Inventive examples showed neither rough surfaces, stretcher strain after secondary forming, nor cracking after secondary forming. On the contrary, comparative examples (steel sheets No. 10 through No. 12) where the Mn contents were out of the scope specified in the present invention showed high r-values, decreased ductility, and the occurrence of rough surfaces and stretcher strain and cracking after secondary working.

Example 2

A series of cold-rolled steel sheets of 0.22 mm in finishing thickness were obtained by using a steel No. E shown in Table 1 and subjecting it to hot-rolling, cold-rolling, continues annealing, and secondary cold-rolling under manufacturing conditions shown in Table 4.

Subsequently, the steel sheets were subjected to continuous tin plating corresponding to #25 in a tin electroplating line of halogen type to give tinplates. Similar analyses to Example 1 were conducted on these product steel sheets. Table 5 demonstrates the results of the analyses. In this connection, as the hot-rolling, a rolling of pair cross type was conducted using a rolling mill having pair cross rolls at all stands, except under a manufacturing condition No. 2-13. As the cold-rolling, a rolling with concurrent use of cross-roll-type and shift roll type rolling using a rolling mill having roll-cross-type stands in the former stage was carried out, and crowns of cold-rolled steel sheets were controlled, except under the manufacturing condition No. 2-13.

Inventive examples showed controlled r-values within a proper range and decreased shrinkage in the can axis direction during secondary forming and minimized blank shapes at early stage. The improvement in yield due to this was about 2%, but it becomes an outstanding benefit in product fields where production quantities are very large. Regarding other properties, the inventive examples had higher properties than those of the comparative examples.

While the above examples were subjected to tin plating, the present invention can also be applied to tin-free steel sheets, complex-plated steel sheets and the like. Separately, the steel sheets of the present invention can be used as coated steel sheets without plating. The present invention can also be applied to such steel sheets as obtained by adhering a resin film onto the surface of steel sheet.

In addition, the steel sheets can be used as steel sheets for two-piece cans without any problems, as well as those for three-piece cans.

Example 3

After taking out from a converter, a molten steel (300 ton) was subjected to decarburization using an RH vacuum degassing apparatus to control its composition to C=0.014 wt %, Si=0.01 wt %, Mn=0.25 wt %, P=0.010 wt %, S=0.005–0.009 wt % and to adjust the temperature of molten steel to a range from 1585 to 1615° C. To this molten steel was added 0.2 to 0.8 kg/ton of Al to conduct preliminary deoxidation for 3 to 4 minutes to reduce the dissolved oxygen concentration in the molted steel to a range from 55 to 260 ppm. In this step, the Al concentration in the molten steel was 0.001 to 0.005 wt %. Then, to this molten steel was added 0.8 to 1.8 kg/ton of a 70 wt % Ti—Fe alloy to conduct Ti-deoxidation over 8 to 9 minutes. After adjusting the composition, a treatment was then carried out by adding to the molten steel a 30 wt % Ca-60 wt % Si alloy, or an additive obtained by adding metallic Ca, Fe, 5 to 15 wt % REM to the alloy, or an Fe-coated wire of 90 wt % Ca-5 wt % Ni alloy or other Ca alloy, REM alloy in a proportion of 0.05 to 0.5 kg/ton. After this treatment, Ti concentration was 0.026 to 0.058 wt %, Al concentration was 0.001 to 0.005 wt %, Ca concentration was 0.0000 to 0.0036 wt %, REM concentration was 0.0000 to 0.0021 wt % and the total concentration of Ca and REM was 0.0005 to 0.0043 wt %.

Next, the steel was subjected to casting using a two strand slab continuous casting apparatus to prepare continuously-cast slabs. In the casting, Ar gas was not blown into tundish and dipping nozzle. After the continuos casting, almost no deposit was observed in the tundish and dipping nozzle.

The continuos-cast slabs were then hot-rolled to a thickness of 1.8 mm. The hot-rolling condition was: slab reheating temperature: 1130° C., finishing rolling temperature: 890° C., hot-rolling coiling temperature: 620° C. The hot-rolled steel sheets were pickled and then cold-rolled to give a cold-rolled steel sheet of 0.18 mm in thickness. Thereafter, the steel sheets were subjected to a shot-time annealing of continuous annealing type at a uniform temperature of 740° C. for 20 sec to give cold-rolled and annealed steel sheets. Test pieces were sampled from the cold-rolled and annealed steel sheets thus obtained and subjected to studies on inclusion structure, r-values and AI values. Tension test pieces of JIS No. 5 were employed in these studies of r-values and AI values. Separately, these steel sheets were subjected to flange cracking evaluation tests and studies on rusting. The results are set forth in Table 6. In this step, most of oxidic inclusions had a width of 50 $\mu$m or less. Oxides were composed of $Ti_2O_3$: 60 to 70%, CaO+REM oxides: 20 to 30%, $Al_2O_3$: 15% or less. In the cold-rolled steel sheets, non-metallic inclusions such as scab, sleever or scale were observed 0.00 to 0.02/1000 m-coil or less.

Separately, for the comparison, a 300-ton molten steel was subjected to decarburization with an RH vacuum degassing apparatus after taken from a converter, and its composition was adjusted to C=0.014 wt %, Si=0.01 wt %, Mn=0.25 wt %, P=0.010 wt %, S=0.002 wt % and the temperature of the molten steel was adjusted to 1590° C. To this molten steel was added 1.2 to 1.6 kg/ton Al to conduct deoxidation. The Al concentration in the molten steel after deoxidation was 0.041 wt % (an Al-killed steel). Thereafter, FeTi was added to the steel and the composition was adjusted. The Ti concentration after this treatment was 0.040 wt %.

The steel was subjected to casting using a two-strand slab continues casting apparatus to give continuously-cast slabs. At this step, major inclusions in the molten steel in a tundish were cluster inclusions having a mean composition of 95 to 98 wt % $Al_2O_3$, 5 wt % or less $Ti_2O_3$.

In the case where Ar gas was not blown into a tundish and dipping nozzle during casting process, a large quantity of $Al_2O_3$ adhered to the nozzle, and the sliding nozzle opening was markedly increased and casting was discontinued due to nozzle plugging at the third charge. In the case where Ar gas was blown in casting process, a large quantity of $Al_2O_3$ adhered in the nozzle, and casting was discontinued at the eighth charge because of increased fluctuations in level of molten steel in the mold.

Next, the continuously-cast slabs were subjected to hot-rolling to 1.8 mm at slab reheating temperature: 1150° C., finishing rolling temperature: 890° C., and hot-rolling coiling temperature: 680° C., and to pickling and to cold-rolling to give cold-rolled steel sheets of 0.18 mm in thickness. Thereafter, the steel sheets were subjected to a shot-time annealing of continues annealing type at a uniform temperature of 750° C. for 20 sec to give cold-rolled and annealed steel sheets. Test pieces were sampled from the cold-rolled and annealed steel sheets thus obtained and subjected to studies on inclusion structure, r-values and AI values. Tension test pieces of JIS No. 5 were employed in these studies of r-values and AI values. Separately, these steel sheets were subjected to flange cracking evaluation tests and studies on rusting. In the cold-rolled steel sheets, non-metallic inclusions such as scab, sleever or scale were observed 0.45/1000 m-coil. The results are shown in Table 6. Table 6 demonstrates the results of the flange cracking test in relation with S−5×((32/40)Ca+(32/140)REM). In this table, steel sheets No. 30 through 35 are steels obtained by a process according to the present invention except the relation among S, Ca and REM, and the steel sheet No. 36 is an Al-killed steel for comparison which was obtained by ingot making.

Table 6 demonstrates that inventive examples each having S−5×((32/40)Ca+(32/140)REM) of 0.0014% or less showed excellent stretch flanging property, r-values less than 1.0, and AI values equal to or less than 30 MPa. The rusting incidences of the steel sheets (after standing at 0° C. at a humidity of 95% for 10 hr) were trivial values.

Industrial Applicability

The present invention can improve yields of materials by reducing widthwise shrinkage in a can axis direction when a three-dimensionally deformed can is produced by imparting strain in the circumferential direction to a cylindrically formed steel sheet.

In addition, the present invention provides extremely stable continues casting without plugging of dipping nozzle during continues casting by controlling inclusions in the steel. The steel sheets of the present invention have less rusting, almost no deterioration in forming property due to inclusions or precipitations, and no surface defects due to cluster inclusions. They are thus steel sheets having satisfactory surface appearance and excellent formability in welded joint, and are exceedingly excellent as steel sheets for three-piece cans.

According to the present invention, can steel sheets having workability and outside properties after working that can meet demands for complicated can design can be manufactured. In addition, according to the present invention, the yields of materials in canmaking can be improved, conferring significant industrial benefits.

TABLE 1

| Steel No. | Chemical Composition (wt %) C | Si | Mn | P | S | Al | N | Other | | Remarks |
|---|---|---|---|---|---|---|---|---|---|---|
| A | 0.030 | 0.01 | 0.55 | 0.01 | 0.005 | 0.05 | 0.0020 | | — | Inventive Example |
| B | 0.040 | 0.01 | 0.60 | 0.01 | 0.010 | 0.05 | 0.0020 | | — | Inventive Example |
| C | 0.050 | 0.01 | 0.55 | 0.01 | 0.010 | 0.04 | 0.0018 | | — | Inventive Example |
| D | 0.060 | 0.01 | 0.65 | 0.01 | 0.007 | 0.05 | 0.0010 | | — | Inventive Example |
| E | 0.070 | 0.01 | 0.60 | 0.01 | 0.006 | 0.04 | 0.0025 | | — | Inventive Example |
| F | 0.080 | 0.01 | 0.52 | 0.01 | 0.010 | 0.04 | 0.0022 | | — | Inventive Example |
| G | 0.080 | 0.01 | 0.55 | 0.01 | 0.008 | 0.04 | 0.0017 | B: | 0.0010 | Inventive Example |
| H | 0.080 | 0.01 | 0.58 | 0.01 | 0.007 | 0.04 | 0.0020 | B: | 0.0020 | Inventive Example |
| I | 0.070 | 0.01 | 0.62 | 0.01 | 0.005 | 0.05 | 0.0020 | B: | 0.0040 | Inventive Example |
| J | 0.003 | 0.01 | 0.30 | 0.01 | 0.006 | 0.04 | 0.0020 | Nb: | 0.030 | Comp. Ex. |
| K | 0.0090 | 0.01 | 0.02 | 0.01 | 0.002 | 0.01 | 0.0029 | | — | Comp. Ex. |
| L | 0.040 | 0.01 | 1.20 | 0.01 | 0.005 | 0.04 | 0.0020 | | — | Comp. Ex. |
| M | 0.040 | 0.01 | 0.60 | 0.01 | 0.010 | 0.003 | 0.0023 | Ti:<br>Ca: | 0.05,<br>0.0012 | Inventive Example |
| N | 0.040 | 0.01 | 0.60 | 0.01 | 0.010 | 0.010 | 0.0030 | V: | 0.04 | Inventive Example |

20

TABLE 2

| Manufacturing Condition | Hot-rolling: Slab Reheating Temperature ° C. | Hot-rolling: Finishing Rolling Temperature ° C. | Hot-rolling: Coiling Temperature ° C. | Cold-rolling: Cold-rolling Reduction % | Continuous Annealing: Annealing Temperature ° C. | Box Annealing: Annealing Temperature ° C. | Box Annealing: Holding Time hr | Secondary: Cold-rolling Reduction % |
|---|---|---|---|---|---|---|---|---|
| 1 | 1150 | 880 | 610 | 90 | 720 | 580 | 3 | 1.3 |

TABLE 3

| Steel Sheet No. | Steel No. | Thickness mm | Structure and Property of Product Steel Sheet: Grain Diameter μm | Volume Percentage of Perlite of 0.5–3 μm | r-Value L direction/ C direction | YS Mpa | Surface Hardness HR30T | Aging Property: Al MPa | Y-El after Aging Treatment L direction/ C direction |
|---|---|---|---|---|---|---|---|---|---|
| 1 | A | 0.22 | 6.7 | 0.8 | 0.60/0.62 | 220 | 51 | 15 | 0.8/1.0 |
| 2 | B | 0.22 | 6.3 | 0.8 | 0.58/0.61 | 225 | 52 | 18 | 0.7/0.9 |
| 3 | C | 0.22 | 6.3 | 0.7 | 0.60/0.62 | 225 | 52 | 18 | 0.5/0.7 |
| 4 | D | 0.22 | 6.4 | 0.8 | 0.61/0.64 | 228 | 53 | 18 | 0.8/1.0 |
| 5 | E | 0.22 | 6.1 | 0.7 | 0.60/0.65 | 230 | 54 | 18 | 0.5/0.9 |
| 6 | F | 0.22 | 6.2 | 0.7 | 0.62/0.65 | 230 | 54 | 20 | 0.7/0.8 |
| 7 | G | 0.22 | 6.3 | 0.8 | 0.67/0.71 | 225 | 52 | 15 | 0.8/1.0 |
| 8 | H | 0.22 | 6.1 | 0.8 | 0.58/0.62 | 230 | 52 | 18 | 0.6/0.8 |
| 9 | I | 0.22 | 6.2 | 0.7 | 0.60/0.62 | 235 | 52 | 18 | 0.8/1.0 |
| 10 | J | 0.22 | 12.0 | 0 | 1.9/2.0 | 170 | 48 | 10 | 0/0 |
| 11 | K | 0.22 | 9.5 | 0.04 | 1.1/1.2 | 260 | 49 | 40 | 4.5/5.1 |
| 12 | L | 0.22 | 6.2 | 1.3 | 0.58/0.60 | 240 | 58 | 25 | 1.5/2.0 |
| 13 | M | 0.22 | 7.3 | 0.7 | 0.77/0.80 | 210 | 52 | 5 | 0.3/0.5 |
| 14 | N | 0.22 | 6.3 | 0.7 | 0.62/0.64 | 220 | 52 | 18 | 0.7/0.9 |

| Steel Sheet No. | Steel No. | Secondary Formability: Changes in Can Height* (mm) | Rough Surface After Secondary Working | St.-St.* Occurrence | EL (%) L direction/ C direction | EL/t Ratio L direction/ C direction | Cracking after Secondary Working | Total Assess-ment | Remarks |
|---|---|---|---|---|---|---|---|---|---|
| 1 | A | 0.80 | good | none | 35/33 | 159/150 | good | accepted | Inventive Example |
| 2 | B | 0.70 | good | none | 34/33 | 155/150 | good | accepted | Inventive Example |
| 3 | C | 0.80 | good | none | 32/31 | 145/141 | good | accepted | Inventive Example |
| 4 | D | 0.68 | good | none | 33/32 | 150/145 | good | accepted | Inventive |

TABLE 3-continued

| | | | | | | | | | |
|---|---|---|---|---|---|---|---|---|---|
| | | | | | | | | | Example |
| 5 | E | 0.82 | good | none | 34/32 | 155/145 | good | accepted | Inventive Example |
| 6 | F | 0.83 | good | none | 32/31 | 145/141 | good | accepted | Inventive Example |
| 7 | G | 0.84 | good | none | 32/31 | 145/141 | good | accepted | Inventive Example |
| 8 | H | 0.71 | good | none | 33/32 | 150/145 | good | accepted | Inventive Example |
| 9 | I | 0.80 | good | none | 33/31 | 150/141 | good | accepted | Inventive Example |
| 10 | J | 2.25 | rough surface | none | 42/41 | 191/186 | good | rejected | Comp. Ex. |
| 11 | K | 0.80 | good | St.-St.occur | 24/23 | 109/105 | cracking | rejected | Comp. Ex. |
| 12 | L | 0.78 | good | none | 23/21 | 105/95 | cracking | rejected | Comp. Ex. |
| 13 | M | 0.87 | good | none | 33/31 | 150/141 | good | accepted | Inventive Example |
| 14 | N | 0.80 | good | none | 33/31 | 150/141 | good | accepted | Inventive Example |

*St.-St.: stretcher strain
*Acceptable range of the shrinkage in can height; within 1 mm

TABLE 4

| | Hot-rolling | | | | Cold-rolling | | Continuous | | | | |
|---|---|---|---|---|---|---|---|---|---|---|---|
| | Slab | Finishing | Coiling | Hot-rolling | Cold- | | Annealing | Box Annealing | | Secondary | |
| Manufac-turing Condition | Reheating Temperature ° C. | Rolling Temperature ° C. | Tem-perature ° C. | Sheet Steel Crown μm | rolling Reduction % | Product Crown μm | Annealing Temperature ° C. | Annealing Temperature ° C. | Holding Time hr | Cold-rolling Reduction % | Remarks |
| 2-1 | 1150 | 880 | 610 | 35 | 90 | 4 | 720 | 580 | 3 | 1.3 | Inventive Example |
| 2-2 | 1050 | 900 | 650 | 40 | 90 | 5 | 760 | 550 | 1 | 1.3 | Inventive Example |
| 2-3 | 1250 | 880 | 610 | 20 | 90 | 2 | 750 | 520 | 2 | 1.3 | Inventive Example |
| 2-4 | 1150 | 880 | 680 | 35 | 90 | 4 | 720 | 580 | 3 | 1.3 | Inventive Example |
| 2-5 | 1150 | 880 | 600 | 30 | 92 | 3 | 720 | 580 | 5 | 3.5 | Inventive Example |
| 2-6 | 1150 | 880 | 620 | 30 | 93 | 3 | 720 | 520 | 8 | 1.3 | Inventive Example |
| 2-7 | 1150 | 890 | 610 | 35 | 90 | 4 | 810 | 520 | 3 | 1.3 | Comp. Ex. |
| 2-8 | 1150 | 890 | 610 | 35 | 90 | 4 | 720 | 380 | 3 | 1.3 | Comp. Ex. |
| 2-9 | 1150 | 880 | 610 | 35 | 90 | 4 | 720 | none | — | 4.0 | Comp. Ex. |
| 2-10 | 1150 | 880 | 610 | 35 | 90 | 4 | none | 580 | 10 | 4.0 | Comp. Ex. |
| 2-11 | 1150 | 890 | 610 | 35 | 90 | 4 | 720 | 550 | 5 | 5.5 | Inventive Example |
| 2-12 | 1150 | 890 | 610 | 35 | 90 | 4 | 680 | 580 | 5 | 1.8 | Inventive Example |
| 2-13 | 1150 | 880 | 610 | 60 | 90 | 9 | 720 | 580 | 3 | 1.3 | Inventive Example |
| 2-14 | 1150 | 740 | 610 | 60 | 90 | 9 | 720 | 580 | 3 | 1.3 | Comp. Ex. |
| 2-15 | 1150 | 890 | 450 | 60 | 90 | 9 | 720 | 580 | 3 | 1.3 | Comp. Ex. |

TABLE 5

| | | | | Structure and Property of Product Steel Sheet | | | | | Aging Property | |
|---|---|---|---|---|---|---|---|---|---|---|
| Steel Sheet No. | Steel No. | Manufac-turing Condition | Thickness mm | Grain Diameter μm | Volume Percentage of Perlite of 0.5–3 μm | r-Value L direction/ C direction | YS Mpa | Surface Hardness HR30T | Al MPa | Y-El after Aging Treatment L direction/ C direction |
| 15 | E | 2-1 | 0.22 | 6.2 | 0.8 | 0.60/0.65 | 230 | 54 | 12 | 0.4/0.5 |
| 16 | | 2-2 | 0.22 | 7.3 | 0.8 | 0.58/0.62 | 225 | 52 | 17 | 0.6/0.8 |
| 17 | | 2-3 | 0.12 | 6.5 | 0.7 | 0.60/0.62 | 235 | 52 | 18 | 0.8/0.9 |
| 18 | | 2-4 | 0.22 | 6.1 | 0.7 | 0.60/0.65 | 220 | 54 | 15 | 0.6/0.7 |
| 19 | | 2-5 | 0.17 | 6.2 | 0.8 | 0.67/0.71 | 215 | 52 | 18 | 0.7/0.9 |

TABLE 5-continued

| | | | | | | | | | |
|---|---|---|---|---|---|---|---|---|---|
| 20 | 2-6 | 0.15 | 5.2 | 0.6 | 0.56/0.62 | 230 | 52 | 18 | 0.7/0.8 |
| 21 | 2-7 | 0.22 | 12.0 | 0.9 | 1.2/1.3 | 180 | 51 | 25 | 1.8/2.0 |
| 22 | 2-8 | 0.22 | 6.3 | 0.7 | 0.56/0.61 | 235 | 54 | 42 | 5.6/6.3 |
| 23 | 2-9 | 0.21 | 6.1 | 0.7 | 0.60/0.62 | 240 | 52 | 50 | 6.3/7.0 |
| 24 | 2-10 | 0.21 | 13.2 | 0 | 1.1/1.2 | 340 | 48 | 10 | 0.3/0.3 |
| 25 | 2-11 | 0.20 | 6.2 | 0.7 | 0.54/0.56 | 380 | 59 | 13 | 0.4/0.5 |
| 26 | 2-12 | 0.22 | 6.2 | 0.3 | 0.60/0.64 | 225 | 57 | 25 | 1.9/2.1 |
| 27 | 2-13 | 0.22 | 6.2 | 0.8 | 0.58/0.61 | 230 | 52 | 18 | 0.7/0.9 |
| 28 | 2-14 | 0.22 | 13.5 | 0.3 | 0.60/0.63 | 210 | 50 | 25 | 0.6/0.7 |
| 29 | 2-15 | 0.22 | 6.2 | 0.7 | 0.58/0.64 | 235 | 52 | 45 | 6.2/6.3 |

| | | Secondary Formability | | | | | | | |
|---|---|---|---|---|---|---|---|---|---|
| Steel Sheet No. | Steel No. | Changes in Can Height* (mm) | Rough Surface After Secondary Working | St.-St.* Occurrence | EL (%) L direction/ C direction | EL/t Ratio L direction/ C direction | Cracking after Secondary Working | Total Assess-ment | Remarks |
| 15 | E | 0.82 | good | none | 34/32 | 155/145 | good | accepted | Inventive Example |
| 16 | | 0.71 | good | none | 33/32 | 150/145 | good | accepted | Inventive Example |
| 17 | | 0.80 | good | none | 21/20 | 175/167 | good | accepted | Inventive Example |
| 18 | | 0.82 | good | none | 34/32 | 155/145 | good | accepted | Inventive Example |
| 19 | | 0.84 | good | none | 30/28 | 176/165 | good | accepted | Inventive Example |
| 20 | | 0.71 | good | none | 26/24 | 173/160 | good | accepted | Inventive Example |
| 21 | | 1.70 | roughsurface | none | 34/33 | 155/150 | good | rejected | Comp. Ex. |
| 22 | | 0.70 | good | St.-St.occur | 24/23 | 109/105 | cracking | rejected | Comp. Ex. |
| 23 | | 0.80 | good | St.-St.occur | 22/21 | 105/100 | cracking | rejected | Comp. Ex. |
| 24 | | 0.80 | roughsurface | none | 32/31 | 152/148 | cracking | rejected | Comp. Ex. |
| 25 | | 0.68 | good | none | 25/22 | 115/110 | fair** | accepted | Inventive Example |
| 26 | | 1.53 | good | none | 29/27 | 132/123 | good | accepted | Inventive Example |
| 27 | | 0.72 | good | none | 33/32 | 150/145 | fair*** | accepted | Inventive Example |
| 28 | | 0.72 | roughsurface | none | 32/31 | 152/148 | fair*** | rejected | Comp. Ex. |
| 29 | | 0.65 | good | St.-St.occur | 22/21 | 105/100 | cracking | rejected | Comp. Ex. |

*St.-St.: stretcher strain
*Acceptable range of the shrinkage in can height; within 1 mm
**Not cracked but extremely partially necking pattern occurred.
***Extremely partially cracking occurred in a sampled piece from the edge of sheet widthwise direction.

TABLE 6

| | | Chemical Composition of Product Steel Sheet (wt %) | | | | | Structure and Property of Product Steel Sheet | | | | | Workability |
|---|---|---|---|---|---|---|---|---|---|---|---|---|
| Steel Sheet No. | Thickness mm | Al | Ca | REM | S | S-5*(CA*32/40 + REM*(32/140)) | Grain Diameter μm | Volume Percentage of Pearlite of 0.5–3 μm | r-value L direction/ C direction | YS MPa | Aging Property Al MPa | Incidence of Flange Cracking % |
| 30 | 0.18 | 0.002 | 0.0007 | 0 | 0.009 | 0.0062 | 6.7 | 0.7 | 0.80/0.81 | 208 | 21 | 12 |
| 31 | 0.18 | 0.002 | 0.0005 | 0.0004 | 0.008 | 0.0055 | 6.8 | 0.8 | 0.75/0.77 | 209 | 20 | 12 |
| 32 | 0.18 | 0.002 | 0 | 0.0005 | 0.008 | 0.0074 | 6.9 | 0.8 | 0.71/0.72 | 211 | 20 | 18 |
| 33 | 0.18 | 0.004 | 0.0015 | 0.0003 | 0.009 | 0.0027 | 6.9 | 0.7 | 0.68/0.69 | 212 | 21 | 8 |
| 34 | 0.18 | 0.004 | 0.0007 | 0 | 0.005 | 0.0022 | 6.8 | 0.8 | 0.68/0.70 | 212 | 21 | 7 |
| 35 | 0.18 | 0.002 | 0.0007 | 0.0002 | 0.005 | 0.0020 | 6.9 | 0.8 | 0.70/0.75 | 210 | 21 | 7 |
| 36 | 0.18 | 0.0041 | 0 | 0 | 0.002 | 0.0020 | 7.1 | 0.9 | 0.75/0.80 | 210 | 20 | 21 |
| 37 | 0.18 | 0.001 | 0.0019 | 0.0006 | 0.009 | 0.0007 | 6.8 | 0.8 | 0.70/0.72 | 210 | 22 | 0 |
| 38 | 0.18 | 0.002 | 0.0011 | 0.0003 | 0.006 | 0.0013 | 6.7 | 0.8 | 0.68/0.70 | 208 | 21 | 1 |
| 39 | 0.18 | 0.002 | 0.0015 | 0.0021 | 0.006 | −0.0024 | 6.8 | 0.7 | 0.71/0.72 | 212 | 18 | 0 |
| 49 | 0.18 | 0.004 | 0.0014 | 0.0009 | 0.006 | −0.0006 | 6.7 | 0.7 | 0.70/0.73 | 211 | 19 | 0 |
| 41 | 0.18 | 0.005 | 0.0019 | 0 | 0.005 | 0.0026 | 6.6 | 0.8 | 0.69/0.71 | 208 | 22 | 0 |
| 42 | 0.18 | 0.005 | 0.0036 | 0.0007 | 0.007 | −0.0082 | 6.8 | 0.8 | 0.70/0.71 | 209 | 22 | 0 |

What is claimed is:

1. A can steel sheet having a composition comprising, in weight %, C:

more than 0.005% and equal to or less than 0.1%, Mn: 0.05% to 1.0%, and a structure composed of a ferrite phase as a principle phase and having a mean grain diameter of 10 μm or less, and further having an r-value of 0.4 or more either in a rolling direction or in a direction perpendicular to the rolling direction and less than 1.0, and an Aging Index AI value of 30 MPa or less.

2. The can steel sheet according to claim 1, wherein said steel sheet has a composition comprising, in weight %, C: 0.03 to 0.1%, Mn: more than 0.5% and equal to or less than 1.0%.

3. The can steel sheet according to either claim 1 or claim 2, wherein said structure comprises ferrite phase as a principle phase, and 0.1 to 1% by volume of pearlite phase each having a grain diameter of 0.5 to 3 μm.

4. The can steel sheet according to either claim 2 or claim 3, wherein said composition consists essentially of, in weight %, C: 0.03 to 0.1%, Mn: more than 0.5% and equal to or less than 1.0%, Al: 0.10% or less, and N: 0.0050% or less with the balance being Fe and incidental impurities.

5. The can steel sheet according to claim 4, wherein said steel further comprises, in addition to the above composition, at least one member selected from, in weight %, Ti: 0.20% or less, B: 0.01% or less, V: 0.1% or less and Nb: 0.1% or less.

6. The can steel sheet according to claim 1, wherein said steel sheet further includes, in addition to the above composition, in weight %. Al: 0.001 to 0.01%, Ti: 0.015 to 0.10%, N: 0.02% or less, a total of 0.0005 to 0.01% of one or two members of Ca, REM, and the content of S and one or two members of Ca, REM meets a relation represented by the following formula:

$$S-5\times((32/40)Ca+(32/140)REM)\leqq 0.0014$$

with the balance being Fe and incidental impurities, and wherein oxidic inclusion having grain diameter of 1 to 50 μm comprises Ti oxides and one or two members of CaO and REM oxides, and wherein the recrystallization texture corresponds to an r-value of 0.1 or less either in the rolling direction or in a direction perpendicular to the rolling direction.

7. The can steel sheet according to claim 6, wherein the oxidic inclusion having grain diameter of 1 to 50 μm comprises: Ti oxides: 20 wt % or more and 90 wt % or less, the total of one or two members of CaO and REM oxides: 10 wt % or more and 40 wt % or less, $Al_2O_3$: 40 wt % or less (the Ti oxides, one or two members of CaO and REM oxides, and $Al_2O_3$ adding up to 100% or less).

8. The can steel sheet according to any one of claims 1 to 7, wherein a total elongation EL (%) has the relation with respect to the thickness t (mm) of EL≧110t.

9. The can steel sheet according to any one of claims 1 to 8, wherein a product steel coil has a sheet crown of 5 μm or less.

10. A method for manufacturing a can steel sheet, comprising the steps of hot-rolling a steel slab containing, in weight %, C: 0.03 to 0.1%, Mn: more than 0.5% and equal to or less than 1.0% at a finishing temperature of 800 to 1000° C., coiling the rolled steel sheet at a temperature of 500 to 750° C., cold-rolling the coiled steel sheet, and then continuously annealing the cold-rolled steel sheet at a recrystallization temperature or higher and 800° C. or lower, and subjecting the steel sheet to box annealing at a temperature higher than 500° C. and equal to or lower than 600° C. for 1 hr or longer.

11. The method for manufacturing a can steel sheet according to claim 1, wherein the annealing temperature of the continuous annealing is controlled to 720° C. or higher.

12. The method for manufacturing a can steel sheet according to either of claim 10 or claim 11, wherein a crown of the hot-rolled steel sheet in the hot-rolling is controlled to 40 μm or less, and a crown of the cold-rolled steel sheet in the cold-rolling is controlled to 5 μm or less.

* * * * *